United States Patent [19]

Mochinaga et al.

[11] Patent Number: 5,074,931

[45] Date of Patent: Dec. 24, 1991

[54] METHOD OF HOT ROLLING CONTINUOUSLY CAST GRAIN ORIENTED ELECTRICAL STEEL SLAB

[75] Inventors: Kishio Mochinaga; Kiyokazu Ichimura; Shinji Shibao; Syuji Kitahara; Shiro Ichikawa, all of Himeji, Japan

[73] Assignee: Nippon Steel Corporation, Tokyo, Japan

[21] Appl. No.: 550,856

[22] Filed: Jul. 10, 1990

[30] Foreign Application Priority Data

Jul. 12, 1989 [JP] Japan ..... 1-179659

[51] Int. Cl.[5] ..... H01F 1/04

[52] U.S. Cl. ..... 148/111; 148/120

[58] Field of Search ..... 148/111, 120

[56] References Cited

U.S. PATENT DOCUMENTS 4,204,891 5/1980 Shiozaki et al. ..... 148/111

FOREIGN PATENT DOCUMENTS 40-28641 12/1965 Japan ..... 148/120

*Primary Examiner*—John P. Sheehan

*Attorney, Agent, or Firm*—Kenyon & Kenyon

[57] ABSTRACT

A continuously cast slab of grain-oriented electrical steel is heated, subjected to heavy-reduction edge rolling at such amount not less than 60 mm as is required for matching with the width of a hot-rolled coil to be produced therefrom, whereafter the dogbones formed in the slab by the heavy-reduction edge rolling are eliminated by horizontal rolling to obtain a flat slab. The flat slab is then heated to a high temperature and hot rolled. Optionally, the edges of the slab can be heated prior to the finish rolling step of the hot rolling process. The method enables production of grain-oriented electrical sheet with high productivity.

3 Claims, 4 Drawing Sheets

METHOD OF HOT ROLLING CONTINUOUSLY CAST GRAIN ORIENTED ELECTRICAL STEEL SLAB

BACKGROUND OF THE INVENTION

1. Field of the Invention

This invention relates to a method used in the process of producing grain-oriented electrical steel sheet, particularly to a method for hot rolling a grain-oriented electrical steel slab produced by continuous casting, and still more particularly to a method of hot rolling a grain-oriented electrical steel slab which improves the productivity of grain-oriented electrical steel sheet by enabling maximization of the width of a continuously cast slab of grain-oriented electrical steel.

2. Description of the Prior Art

Grain-oriented electrical steel sheet has superior magnetic properties, specifically high flux density and low core loss, and is therefore widely used as a core material for transformers and the like.

In recent years, a demand has arisen in this field of technology for the supply of grain-oriented electrical steel sheet with even more superior magnetic properties at even lower prices. Thus engineers in this field are being required to find ways for raising productivity and improving yield while at the same time reducing production costs.

With a view to increasing productivity, ensuring reliable material quality and the like, nearly all grain-oriented electrical steel slab is currently produced by continuous casting. Productivity in continuous casting is a function of casting speed and casting size. More specifically, the casting speed is selected to be the highest allowable within the restrictions dictated by the need to maintain stable casting performance. On the other hand, the casting size is selected as that most suitable for the manufacture of products of the desired size in the ordinary hot rolling process. Moreover, since product size varies greatly, it is also necessary to provide the materials for their production in a wide range of sizes and, therefore, the casting size is not necessarily set at the maximum allowable within the restrictions dictated by the need to maintain stable casting performance.

What is required most for upgrading productivity in continuous casting is, therefore, increasing (maximizing) slab width to the largest allowable by the facility capability.

In view of this need, techniques have been proposed for carrying out heavy-reduction edge rolling in the hot rolling step so as to reduce the slab width to that required for the particular product to be manufactured, in, for example, Japanese Published Patent Application Nos. 59(1984)-42561 and 1(1989)-12561 and other publications. Published Application No. 59(1984)-42561 discloses a method for high-yield edging of a wide continuously cast slab by the use of large-diameter edgers in the hot rolling step. On the other hand, Published Application No. 1(1989)-12561 discloses a method for adjusting the composition and slab cooling rate of medium- and low-carbon steels to optimum values for preventing cracking and the occurrence of flaws during heavy-reduction hot rolling.

SUMMARY OF THE INVENTION

Heavy-reduction hot edge rolling of continuously cast slab is highly effective for increasing the productivity in terms of amount of production per unit time (ton/hr) in the continuous casting process. The inventors therefore conducted a study on the production conditions in the continuous casting process for manufacturing a grain-oriented electrical steel slab containing Si (e.g. at 2.5–4.0%) to which the aforesaid heavy-reduction hot edge rolling is applied.

One characteristic of the production of grain-oriented electrical steel sheet is that the slab is maintained at a high temperature (e.g. 1300° C.) for a prolonged period prior to hot rolling. However, flaws known as edge cracks are apt to occur in the hot rolled sheet obtained by this hot rolling and these tend to reduce product yield and lower operating efficiency during pickling and cold rolling.

Moreover, particularly for the purpose of lowering the core loss of grain-oriented electrical steel sheet, it has become the practice in recent years not only to increase the amount of added Si and C but also to additionally add Cu, Sn, Sb and the like. As a result of the increase in the amounts of Si and C, however, a large number of edge cracks tend to occur in the hot rolled sheet. On top of this, edge cracking of the hot rolled sheet is further promoted when the continuously cast grain-oriented electrical steel slab is subjected to heavy-reduction edge rolling, namely when the slab is subject to rolling that consists in large part of strong working of the slab edges. Therefore, for improving productivity of grain-oriented electrical steel slab produced by continuous casting for use in the production of grain-oriented electrical steel sheet, it is of utmost importance to be able to conduct heavy-reduction edge rolling of the grain-oriented electrical steel slab in a way that does not promote such edge cracking of the hot rolled sheet.

It is therefore the main object of this invention to provide a method of hot rolling continuously cast grain-oriented electrical steel slab which enables heavy-reduction edge rolling to be conducted in a manner that does not promote, but to the contrary mitigates, edge cracking of grain-oriented electrical steel sheet produced therefrom, and thus contributes to improvement of the productivity of the grain-oriented electrical steel slab in the continuous casting step.

Another object of this invention is to provide a method of hot rolling continuously cast grain-oriented electrical steel slab which enables the grain-oriented electrical steel slab to be stably and efficiently heated in an electric heating furnace after it has been subjected to heavy-reduction edge rolling.

Another object of this invention is to provide a method of hot rolling continuously cast grain-oriented electrical steel slab which particularly prevents the occurrence of edge cracks at the tip portion of the hot rolled sheet and enables production of grain-oriented electrical steel sheet with only an extremely small number of edge cracks throughout its entire length.

The above and other objects and features of the present invention will become apparent from the following description made with reference to the drawings.

DETAILED DESCRIPTION OF THE INVENTION

Figure 1:
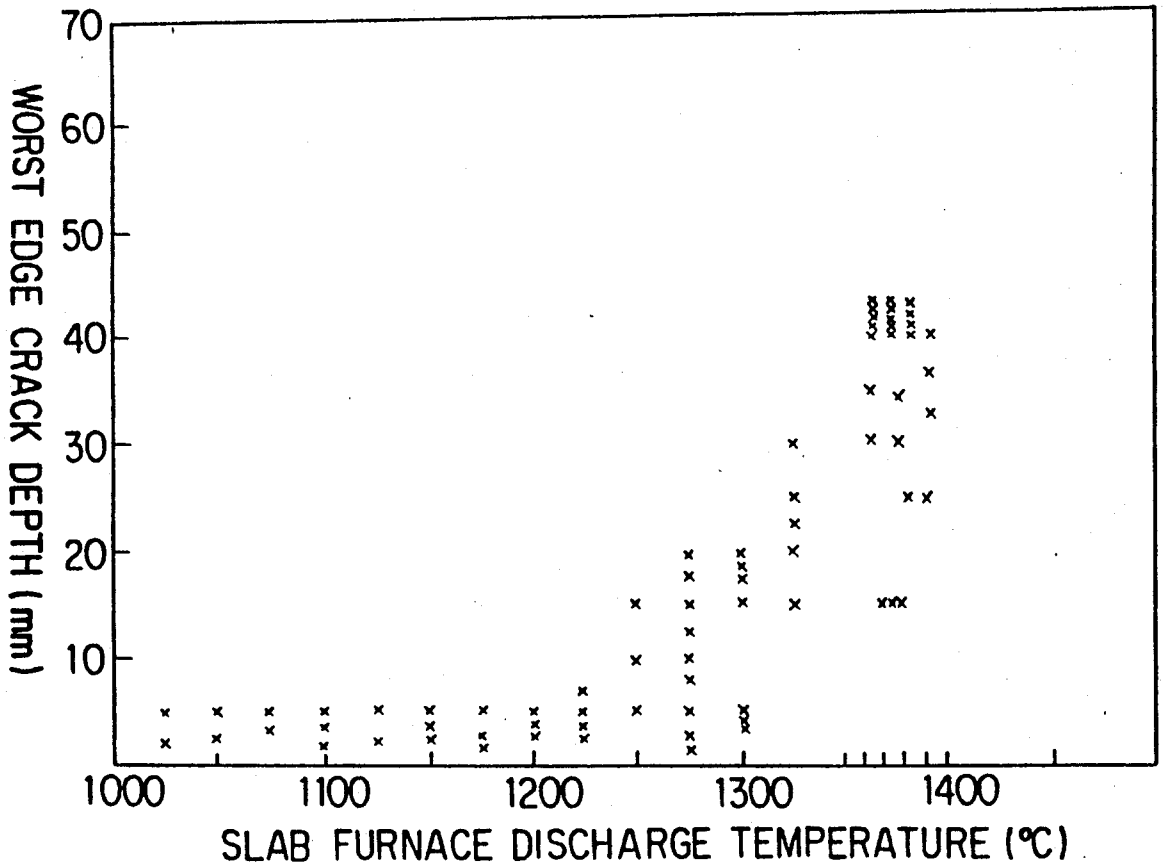
FIG. 1 is a graph showing the relationship between the furnace discharge temperature of the slab and the worst edge crack depth.

For achieving the aforesaid objects, the present invention provides a method of hot rolling a continuously cast grain-oriented electrical steel slab that enables improvement of productivity in the continuous casting process wherein a grain-oriented electrical steel slab produced by continuous casting is heated, the heated slab is subjected to heavy-reduction edge rolling matched to the required width of a hot-rolled coil following hot rolling and the edge rolled slab is then hot rolled, the hot rolling process including the following steps:

(1) heating the grain-oriented electrical steel slab in a gas-fired heating furnace to a temperature in the range of 900°-1250° C., (2) subjecting the heated grain-oriented electrical steel slab to heavy-reduction edge rolling of not less than 60 mm, (3) eliminating the dogbones formed in the grain-oriented electrical steel slab by the heavy-reduction edge rolling by rolling with horizontal rolls, (4) heating the flat grain-oriented electrical steel slab eliminated of the dogbones in an electric heating furnace to a temperature in the range of 1300°-1450° C., and (5) rough rolling and finish rolling the grain-oriented electrical steel slab electrically heated to said high temperature.

These steps make it possible to obtain a hot rolled sheet with very few edge cracks. The hot rolled sheet obtained in this manner is further processed into the final product by conventionally employed methods including, but not limited to, various types of annealing and cold rolling.

The present invention further provides a method of hot rolling a continuously cast grain-oriented electrical steel slab which further includes in the hot rolling process the following steps following the aforesaid step (4):

(6) rough rolling the grain-oriented electrical steel slab electrically heated to said high temperature to a thickness of not more than 100 mm, (7) before finishing rolling the rough rolled grain-oriented electrical steel slab, heating both widthwise edges at least at the tip thereof in the lengthwise direction in an electric heating furnace to a temperature of not less than 900° C. and not more than the temperature at the center of the slab, and (8) finish rolling the grain-oriented electrical steel slab maintained at not less than 900° C. throughout its width.

When these steps are also carried out, edge cracking of the tip of the hot rolled sheet can be almost totally prevented.

As still another feature of the present invention, it is preferable to carry out the rolling of the dogbones with horizontal rolls in such manner that the dogbones are eliminated and, further, the thickness of the slab is reduced.

The invention will now be explained in detail.

The inventors conducted various studies regarding the relationship between the heating temperature, heavy-reduction edge rolling, rough rolling and finish rolling of a continuously cast grain-oriented electrical steel slab and edge cracking of the resulting hot rolled sheet. The results of these studies are shown in FIG. 1.

As can be seen in this figure, when the slab heating temperature (the temperature of the slab upon its discharge from the heating furnace) exceeds 1250° C., the depth of the edge cracks in the hot rolled sheet become deep. This is because the grain growth is large at high heating temperature, making it easy for cracking to occur at the grain boundaries. On the other hand, when the heating temperature of the slab is less than 900° C., the rolling resistance increases to make it difficult to carry out heavy-reduction edge rolling.

For these reasons, the present invention limits the heating temperature of the continuously cast grain-oriented electrical steel slab prior to heavy-reduction edge rolling to 900°-1250° C.

The results shown in FIG. 1 were obtained by tests wherein a slab comprised of 0.07% C, 3.25% Si, 0.07% Mn, 0.01% P, 0.024% S, 0.024% Al, 0.0090% N, 0.05% Cu, 0.10% Sn and the balance substantially of Fe was initially formed to a width of 1200 mm and a thickness of 250 mm, subjected to heavy-reduction edge rolling of 100 mm, and hot rolled to obtain a hot-rolled coil of 2.5 mm thickness.

In the present invention, the heating of the continuously cast grain-oriented electrical steel slab prior to heavy-reduction edge rolling (hereinafter called the "primary heating") is carried out in a gas-fired heating furnace. This is because, for example, (a) the primary heating is conducted at a low temperature and thus generates little molten slag, (b) gas-fired heating furnaces are already widely used at existing facilities for the heating of continuously cast grain-oriented electrical steel slab and (c) heating by a gas-fired heating furnace is more economical than other heating methods.

The continuously cast grain-oriented electrical steel slab raised to a temperature of 900°-1250° C. by the primary heating is immediately conveyed to the rolling line where it is subjected to heavy-reduction edge rolling (in one or more passes). As was mentioned earlier, the main object of this invention is to improve the productivity in the continuous casting process. To this end, the casting size of the grain-oriented electrical steel slab produced in the continuous casting process is fixed at the largest width (large thickness also of course being preferable) allowable within the restrictions dictated by the need to maintain stable casting performance, and the resulting slab is edged by the aforesaid heavy-reduction edge rolling to obtain the required hot-rolled coil width after hot rolling.

When, as is the conventional practice, the grain-oriented electrical steel slab is edge rolled after being heated to 1300° C. or higher, the relationship between the amount of edging and the depth of the edge cracks in the hot rolled sheet is such that the depth of the edge cracks is not so large at an edge rolling reduction of not more than 60 mm. However, when the amount of edging exceeds 60 mm, the depth of the edge cracks in the hot rolled sheet becomes large. Therefore, the present invention pertains to edging amounts of 60 mm or greater, namely to edging amounts which at the conventionally used heating temperatures result in deep edge cracking of the hot rolled sheet. The invention thus makes it possible to conduct heavy edging, thereby enabling hot rolled sheets of desired widths to be obtained from continuously cast grain-oriented electrical steel slab of a fixed width.

While there are no particular limits on the kind of heavy-reduction edge rolling machine to be used in this invention, it is preferable to employ the large-diameter vertical edger machine described in Japanese Published Patent Application No. 59(1984)-42561.

Figure 2:
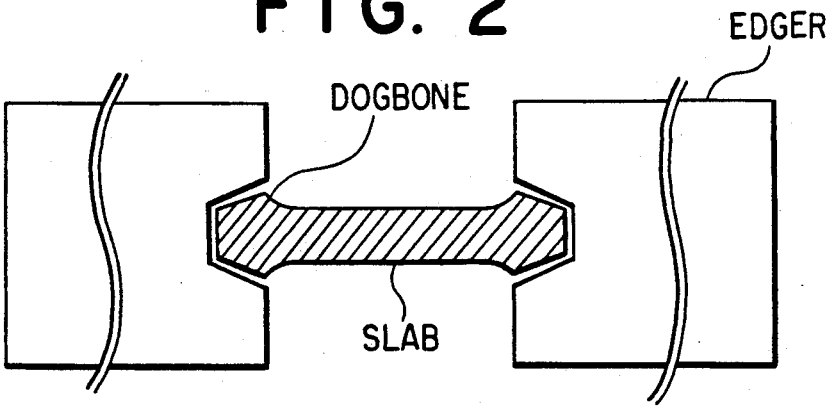
FIG. 2 is an explanatory view showing the formation of a dogbones by edge rolling.

As shown in FIG. 2, so-called "dogbones" are formed at the upper and lower surfaces of the grain-oriented electrical steel slab which has been subjected to heavy-reduction edge rolling for obtaining a slab width appropriate for obtaining a hot rolled sheet of the desired width. The grain-oriented electrical steel slab having these dogbones causes a major problem in the secondary heating.

This problem arises because, for reasons that will be explained later, the present invention uses an induction heating furnace or other type electric furnace for the secondary heating. The presence of the dogbones in the grain-oriented electrical steel slab at the time it is charged into the electric heating furnace for heating would make it difficult to charge the slab into the furnace and also make it difficult to maintain it in a stable vertical posture. Thus there would be such problems as a high risk of damaging the furnace wall, non-uniform heating of the slab, and the like.

For overcoming these problems, the present invention calls for the dogbones at the upper and lower surfaces of the grain-oriented electrical steel slab to be eliminated by rolling with horizontal rolls prior to secondary heating.

Figure 3:
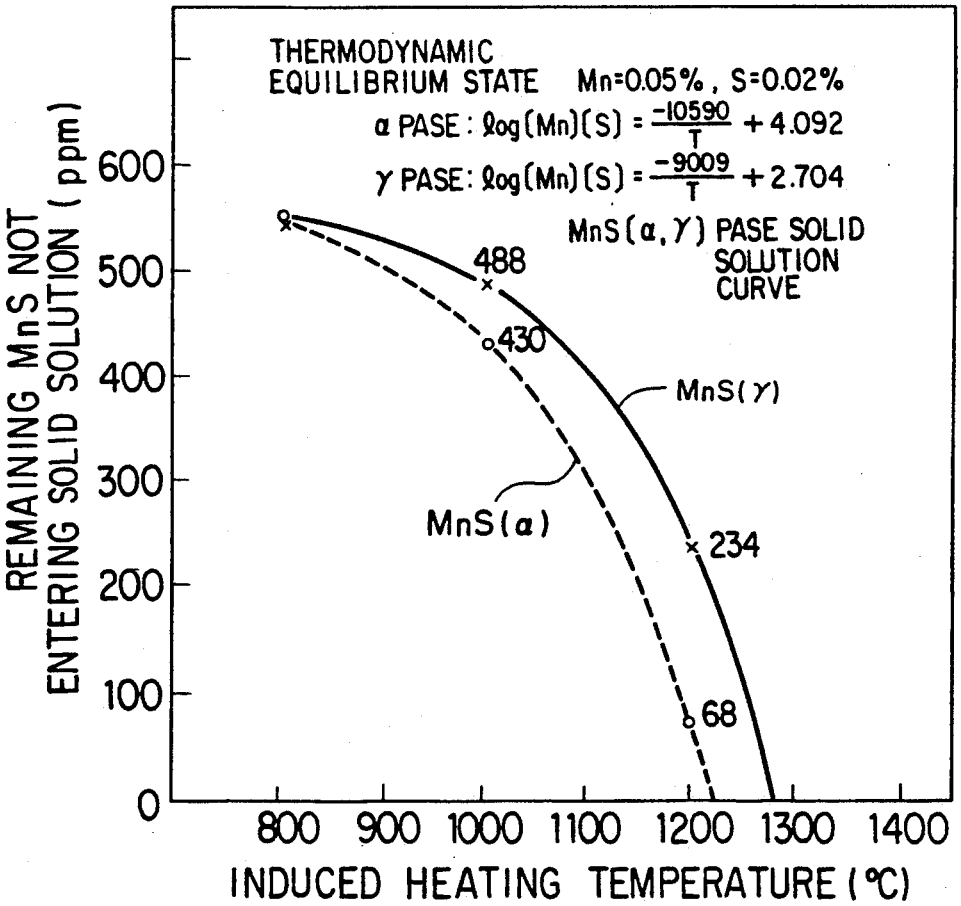
FIG. 3 is graph showing the relationship between induced heating temperature and a MnS ($\alpha$, $\gamma$ phase) solid solution curve.

The secondary heating is required for causing the MnS, AlN etc. contained by the slab to enter solid solution and thus ensure that the final product will have excellent magnetic properties. The temperature of this heating is limited to the range of 1300°-1450° C. FIG. 3 shows the solid solution curve vs. the MnS $\alpha$, $\gamma$ phase heating temperature for a material containing 0.05% Mn and 0.02% S. As can be seen from this graph, heating to a temperature of 1300° C. or higher is required for entry of an adequate amount of MnS into solid solution.

In this case, if the temperature is lower than 1300° C., the amount of MnS entering solid solution is insufficient, making it impossible to obtain excellent magnetic properties. On the other hand, if the heating is conducted to a temperature higher than 1450° C., the risk of autogenous cutting arises since the temperature is near the melting temperature of the slab.

When the dogbones are eliminated with the horizontal rolls, it is advantageous from the point of carrying out further heating in the electric furnace not only to eliminate the dogbones but also to reduce the thickness of the slab itself by a prescribed amount. Specifically, in case where the thickness of the grain-oriented electrical steel slab exceeds that which the electric heating furnace can, in light of its rated heating capacity, heat efficiently, it is preferable not only to eliminate the dogbones in the aforesaid manner but also to reduce the thickness of the slab itself to one which the electric heating furnace can heat effectively, since this both increases the heating efficiency of the grain-oriented electrical steel slab in the electric heating furnace and enables uniform heating.

Japanese Published Unexamined Patent Application No. 62(1987)-130217 discloses a method wherein a slab is heated in a combustion type heating furnace to a center temperature of 900°-1250° C., imparted with 10-50% hot deformation by rough rolling, and then heated to 1350°-1420° C. in an induction heating furnace.

In contrast, one of the basic features of the present invention is that, with the aim of improving the productivity of a grain-oriented electrical steel slab in the continuously cast production process, the grain-oriented electrical steel slab is heated to a low temperature in a primary heating step, subjected to heavy-reduction edge rolling, rolled with horizontal rolls for eliminating the dogbones that are unavoidably produced in the heavy-reduction edge rolling step, and then heated to a high temperature in a secondary heating step. Since the aforesaid Published Unexamined Patent Application does not touch at all on this feature, the present invention and this prior art technology are unrelated.

After the secondary heating, rough rolling and finish rolling are conducted in the ordinary manner to produce a grain-oriented electrical steel sheet that is wound into a hot-rolled coil.

It was found that, depending on the slab processing conditions, particularly on the hot rolling (step (5) in claim 1) conditions, it is sometimes impossible by the steps of the invention explained above to completely eliminate the occurrence of edge cracking in the hot rolled sheet.

Figure 4:
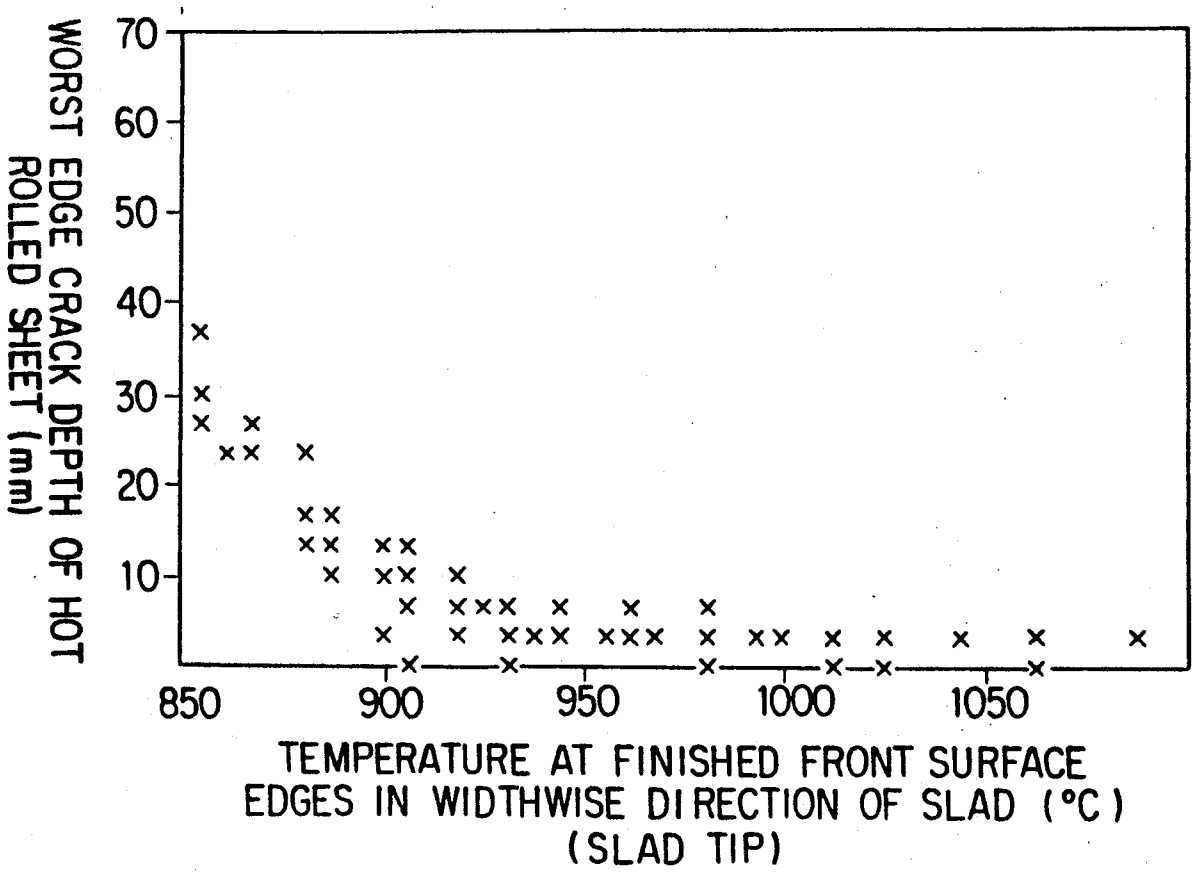
FIG. 4 is a graph showing the relationship between the temperature of the finished front surface edges in the widthwise direction of the slab and the worst edge crack depth.
Figure 5:
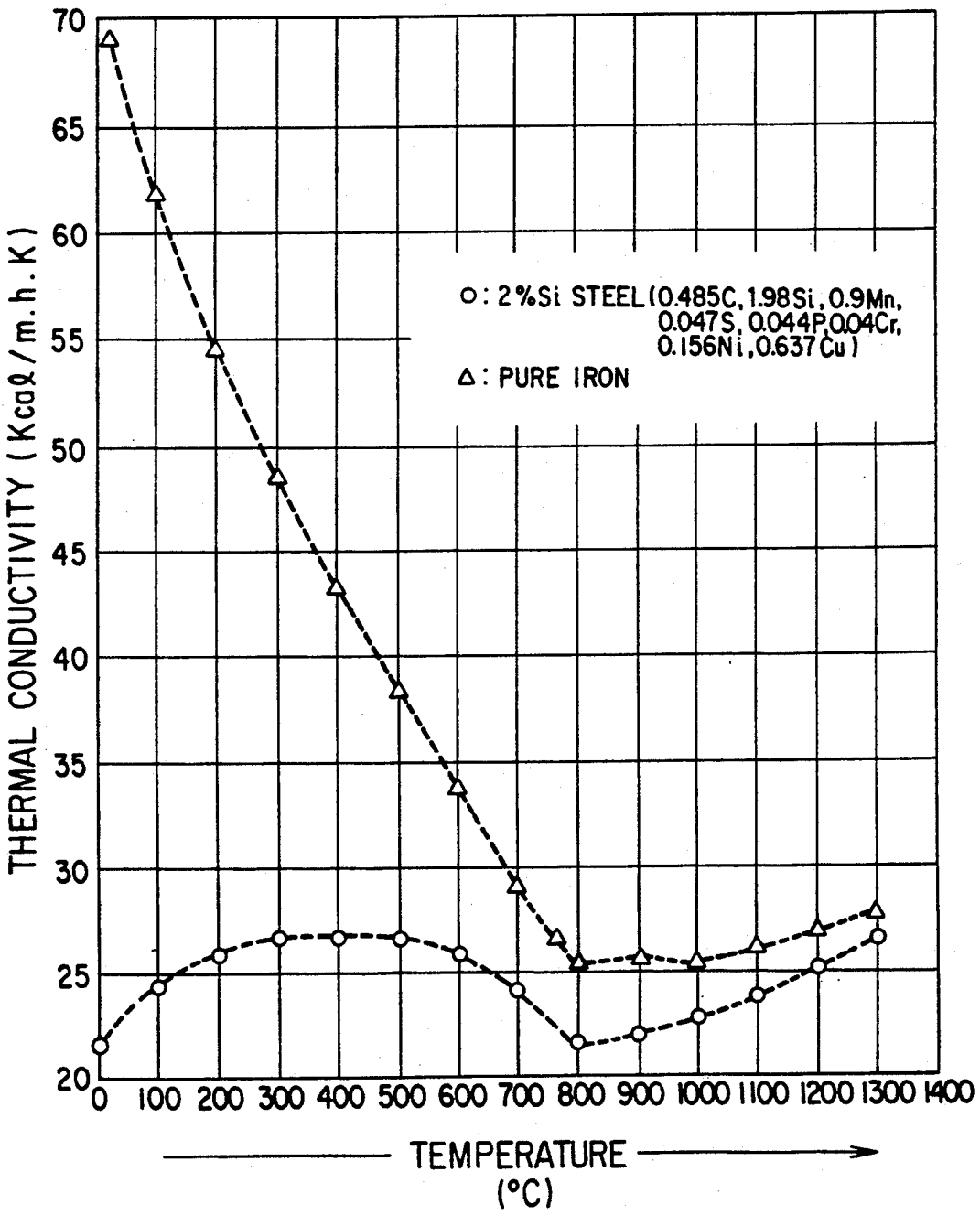
FIG. 5 is a graph showing the relationship between temperature and thermal conductivity in materials of differing composition.

More specifically, in the case where the slab is heated in the secondary heating step, rolled to a thickness of not more than 100 mm by one or more horizontal rolling passes in the succeeding rough rolling step and rolled to the desired hot rolled sheet thickness in the following finish rolling step, the thin slab measuring not more than 100 mm in thickness, particularly the tip in the lengthwise direction thereof, is excessively cooled in the finish rolling step by heat removal through contact with the rolls or through cooling by the roll cooling water, and, as shown in FIG. 4, when the temperature at the opposite edge portions of the thin slab falls to 900° C. or lower, the edge cracks of the hot rolled thin sheet become large. This is considered to be related to the fact that, as shown in FIG. 5 (based on data from Steel Manual, Fundamentals Vol., pp 213-216), at 900° C. a high Si-content steel such as the grain-oriented electrical steel with which the present invention is concerned has lower thermal conductivity than pure iron, and it is thought that when the thin slab of grain-oriented electrical steel is gripped by the rolls in finish rolling after completion of rough rolling and the temperature of the tip thereof is excessively cooled to 900° C. or below, its hot rolling deformation resistance increases sharply, giving rise to edge cracking during the ensuing finish rolling.

For this reason, in the present invention, prior to finish rolling, both widthwise edges at least at the tip of the thin slab (thickness $<100$ mm) in the lengthwise direction are heated in an electric heating furnace to a temperature of not less than 900° C. and not more than the temperature at the center of the slab. The reason for specifying the heating temperature of the widthwise edges of the thin slab to be not higher than the temperature at the center of the slab is that degradation of the magnetic properties due to insufficient precipitation of MnS would occur should the temperature of the widthwise edges of the thin slab become higher than that at the center in the widthwise direction thereof.

The "tip of the slab in the lengthwise direction" typically refers to the portion extending back to about 10 meters (about 1/5 of the total slab length) from the leading end of the slab, although this is not intended to be a ridged definition.

While the heating of the opposite widthwise edge portions need only be carried out with respect to that part of these portions whose temperature has fallen to 900° C. or less, namely with respect to these portions at the tip of the slab in the lengthwise direction, it can optionally be carried out, without adverse effect, with respect to the widthwise edge portions over the entire slab length.

Following this heating, the slab is finish rolled in the conventional manner, and the result is wound into a coil to obtain a hot-rolled coil of grain-oriented electrical steel that has few edge cracks throughout its length and is of high yield.

The thickness of the slab prior to finish rolling is specified as being not more than 100 mm for reasons related to the finish rolling capability.

By the aforesaid process according to this invention it is possible to produce a hot-rolled coil having no, or at any rate exceedingly few, edge cracks. The so-obtained hot-rolled coil can thereafter be processed by the ordinary method for producing grain-oriented electrical steel sheet to obtain the final product.

Although the present invention places no restrictions on the composition of the grain-oriented electrical steel slab whatsoever, the respective components should preferably be within the following ranges The C content should preferably be within the range of 0.025–0.085% because when it is present at less than 0.025% the secondary recrystallization becomes unstable and when it is present in excess of 0.085% the time required for the decarburization annealing becomes so long as to be economically disadvantageous. The Si content should preferably be in the range of 2.5–4.5% because when it is present at less than 2.5% it is not possible to obtain a good core loss property and when it is present in excess of 4.5% the cold rollability of the steel deteriorates markedly. Two or more of Mn, S, Sol.Al, N, Cu and Sn are, as required, added as inhibitor-forming elements and the contents thereof should respectively be 0.01–0.10%, 0.01 –0.04%, 0.0005–0.065%, 0.002–0.010%, 0.01–0.50% and 0.05–0.50%. Additionally, Sb, Bi, V, Ni, Cr and B are added a required.

The invention will now be explained with respect to specific examples.

EXAMPLE 1

Slabs consisting of 0.08% C, 3.25% Si, 0.07% Mn, 0.01% P, 0.028% S, 0.027% Al, 0.0090% N, 0.05% Cu, 0.05% Sn and the balance substantially of Fe and measuring 250 mm in thickness and 1200 mm in width were prepared. Each slab was subjected to heating in a gas heating furnace to one of three temperatures, 1000° C., 1200° C. and 1400° C., to one of three degrees of edging (edge rolling), 0 mm, 100 mm and 400 mm, wa thereafter horizontally rolled (either for flattening by removal of the dogbones or for reduction from a slab thickness of 250 mm to 200 mm), and then charged in an electric furnace and heated to 1400° C.

Next the resulting slab (thickness of 250 mm or 200 mm) was hot rolled to a hot-rolled coil sheet thickness (2.5 mm).

This grain-oriented electrical steel sheet was then processed into a high flux density grain-oriented electrical sheet in the conventional manner by pickling, preliminary cold rolling, hot rolled sheet annealing, cold rolling to 0.220 mm, decarburization of the resulting cold rolled sheet by a conventional method, application of a freezing inhibitor, final annealing, and application of a tension coating.

The worst edge crack depth, product properties and unit power consumption in the electric heating furnace of the hot-rolled coils produced by this process are shown in Table 1.

TABLE 1

| | No. | Slab width (mm) | Gas heating temp. (°C.) | Edging amount (mm) | Horizontal rolling amount (mm) | Electric furnace heating temp. (°C.) | Horizontal rolling amount (mm) | Hot coil width (mm) |
|---|---|---|---|---|---|---|---|---|
| Comparison | 1 | 1200 | 1400 | 0 | 0 | — | 250/2.5 | 1200 |
| material | 2 | " | " | 100 | 0 | — | " | 1100 |
| Comparison | 3 | 1200 | 1200 | 0 | 0 | 1400 | 250/2.5 | 1200 |
| Invention | 4 | " | " | 100 | Dogbone elimination | " | 250/2.5 | 1100 |
| | 5 | " | " | " | 250/200 | " | 200/2.5 | " |
| | 6 | " | " | 400 | Dogbone elimination | " | 250/2.5 | 800 |
| | 7 | " | " | " | 250/200 | " | 200/2.5 | 800 |
| Comparison | 8 | 1200 | 1000 | 0 | 0 | 1400 | 250/2.5 | 1200 |
| Invention | 9 | " | " | 100 | Dogbone elimination | " | 250/2.5 | 1100 |
| | 10 | " | " | " | 250/200 | " | 200/2.5 | " |
| | 11 | " | " | 400 | Dogbone elimination | " | 250/2.5 | 800 |
| | 12 | " | " | " | 250/200 | " | 200/2.5 | 800 |

| | | No. | CC production increase (%) | Hot coil worst crack value (mm) | Magnetic properties $W_{17/50}$ (W/kg) | Magnetic properties $B_8$ (γ) | Unit power consumption (kWH/ton) |
|---|---|---|---|---|---|---|---|
| | Comparison | 1 | 0 | 40 | 0.86 | 1.93 | — |
| | material | 2 | 8 | 130 | 0.85 | 1.92 | — |
| | Comparison | 3 | 0 | 7 | 0.84 | 1.92 | 80 |
| | Invention | 4 | 8 | 7 | 0.85 | 1.92 | 80 |
| | | 5 | 8 | 8 | 0.83 | 1.93 | 60 |
| | | 6 | 33 | 8 | 0.84 | 1.92 | 80 |
| | | 7 | 33 | 10 | 0.83 | 1.92 | 60 |
| | Comparison | 8 | 0 | 5 | 0.84 | 1.92 | 160 |
| | Invention | 9 | 8 | 7 | 0.85 | 1.92 | 160 |
| | | 10 | 8 | 8 | 0.82 | 1.93 | 140 |
| | | 11 | 33 | 8 | 0.84 | 1.92 | 160 |

TABLE 1-continued

| | | | | | | |
|---|---|---|---|---|---|---|
| 12 | 33 | 9 | 0.83 | 1.93 | 140 |

Remarks:
1. Horizontal rolling amount of 250/200 refers to rolling from a slab thickness to 250 mm to a slab thickness of 200 mm.
2. Horizontal rolling amount of 200/2.25 refers to rolling from a slab thickness of 200 mm to a sheet thickness of 2.5 mm.

From the results shown in Table 1, it will be understood that:

No. 1 is poor in continuous casting productivity.

No. 2 is poor in edge crack property.

No. 3 is poor in continuous casting productivity.

Nos. 4–7 are good in continuous casting productivity and edge crack property (with Nos. 5 and 7 being fairly good in magnetic properties and good in unit power consumption).

Nos. 9–12 are similar to Nos. 4–7 except that since the gas heating temperature was low (1000° C.), the amount of heating required in the electric heating furnace was large, making the unit power consumption poor in Nos. 9–12.

EXAMPLE 2

Slabs of the same composition and size as those in Example 1 were prepared. Each slab was subjected to heating in a gas heating furnace to one of two temperatures, 1000° C. and 1200° C., to 400 mm edging (edge rolling), was thereafter horizontally rolled (either for flattening by removal of the dogbones or for reduction from a slab thickness of 250 mm to 200 mm), was charged in an electric furnace and heated to 1400° C., was then subjected to about 85% or about 80% horizontal rolling until it reduced to a slab thickness of 40 mm, was charged in an electric tip portion heating furnace to have its tip portion heated to one of two temperatures, 990° C. and 1020° C., and was rolled to a hot-rolled coil sheet thickness of 2.5 mm. The temperature of the center portion of the slab at this time was 1300° C.

The result was thereafter subjected to the same processing as in Example 1 to obtain a high flux density grain-oriented electrical sheet. The worst edge crack depth, product properties and unit power consumption in the electric heating furnace of the hot-rolled coils produced by this process are shown in Table 2.

TABLE 2

| | No. | Slab width (mm) | Gas heating temp. (°C.) | Edging amount (mm) | Horizontal rolling amount before electric heating (mm) | Electric furnace heating temp. (°C.) | Rough horizontal rolling amount (mm) | Temp. at opposite widthwise edges at thin slab tip (°C.) | Horizontal finish rolling amount (mm) |
|---|---|---|---|---|---|---|---|---|---|
| Invention | 13 | 1200 | 1200 | 400 | Dogbone elim. | 1000 | 250/40 | 990 | 40/2.5 |
| | 14 | " | " | " | 250/200 | " | 200/40 | " | " |
| | 15 | " | " | " | " | " | 200/40 | 1020 | " |
| | 16 | " | 1400 | " | Dogbone elim. | " | 250/40 | 990 | " |
| | 17 | " | " | " | 250/200 | " | 200/40 | " | " |
| | 18 | " | " | " | " | " | 200/40 | 1020 | " |

| | No. | Hot coil width (mm) | CC production increase (%) | Hot coil worst crack value (mm) | Magnetic properties $W_{17/50}$ (W/kg) | Magnetic properties $B_8$ (γ) | Unit power consumption (kWH/ton) |
|---|---|---|---|---|---|---|---|
| Invention | 13 | 800 | 33 | 3 | 0.83 | 1.93 | 85 |
| | 14 | " | " | 2 | 0.82 | 1.92 | 65 |
| | 15 | " | " | 3 | 0.82 | 1.93 | 70 |
| | 16 | " | " | 3 | 0.83 | 1.93 | 165 |
| | 17 | " | " | 3 | 0.83 | 1.92 | 145 |
| | 18 | " | " | 2 | 0.82 | 1.93 | 150 |

Remarks:
1. Horizontal rolling amount before electric heating of 250/200 refers to rolling from a slab thickness to 250 mm to a slab thickness of 200 mm.
2. Rough horizontal rolling amount of 200/40 refers to rolling from slab thickness of 200 mm to a thin slab thickness of 40 mm.
3. "Tin slab tip" refers to a leading 1/5 of 40 mm slab length (approx. 10 m)
4. "Temp. at opposite widthwise edges at thin slab tip" refers to the temperature of this portion at the time of gripping in finish rolling.
5. Finish horizontal rolling amount of 40/2.25 refers to rolling from a thin slab thickness of 40 mm to a hot coil thickness of 2.5 mm.

From the results shown in Table 2 it will be understood that Nos. 13–18 are good in continuous casting productivity and are extraordinarily good in edge crack property (with Nos. 14 and 15 also being fairly good in magnetic properties and good in unit power consumption).

However, in Nos. 16–18, since the gas heating temperature was low (1000° C.), the amount of heating required in the electric heating furnace was large, making the unit power consumption poor.

EXAMPLE 3

Slabs consisting of 0.044% C, 3.0% Si, 0.06% Mn, 0.01% P, 0.020% S, 0.0020% Al, 0.0040% N, 0.17% Cu and the balance substantially of Fe and measuring 250 mm in thickness and 1200 mm in width were prepared. Each slab was subjected at a gas-heated temperature of 1200° C. to edge rolling at one of three degrees of edging, 0 mm, 100 mm and 400 mm, was thereafter horizontally rolled (either for flattening by removal of the dogbones or for reduction from a slab thickness of 250 mm to 200 mm), and then charged in an electric furnace and heated to 1400° C. and the resulting slab (thickness of 250 mm or 200 mm) was hot rolled to hot-rolled coil sheet thickness (2.5 mm). This grain-oriented electrical steel sheet was then processed into a high flux density grain-oriented electrical sheet in the conventional manner by pickling, preliminary cold rolling, intermediate annealing by a conventional method, cold rolling to 0.30 mm, decarburization, application of a freezing inhibitor, final annealing, and application of a tension coating, to thereby obtain a grain-oriented electrical steel sheet. The worst edge crack depth, product properties and unit power consumption in the electric heating furnace of the hot-rolled coils produced by this process are shown in Table 3.

TABLE 3

| | No. | Slab width (mm) | Gas heating temp. (°C.) | Edging amount (mm) | Horizontal rolling amount (mm) | Electric furnace heating temp. (°C.) | Horizontal rolling amount (mm) | Hot coil width (mm) |
|---|---|---|---|---|---|---|---|---|
| Comparison | 19 | 1200 | 1400 | 0 | 0 | — | 250/2.5 | 1200 |
| Invention | 20 | 1200 | 1200 | 100 | Dogbone elimination | 1400 | 250/2.5 | 1100 |
| | 21 | " | " | " | 250/200 | " | 200/2.5 | " |
| | 22 | " | " | 400 | Dogbone elimination | " | 250/2.5 | 800 |
| | 23 | " | " | " | 250/200 | " | 200/2.5 | 800 |

| | No. | CC production increase (%) | Hot coil worst crack value (mm) | Magnetic properties $W_{17/50}$ (W/kg) | Magnetic properties $B_8$ (γ) | Unit power consumption (kWH/ton) |
|---|---|---|---|---|---|---|
| Comparison | 19 | 0 | 15 | 1.20 | 1.84 | – |
| Invention | 20 | 8 | 4 | 1.19 | 1.84 | 80 |
| | 21 | 8 | 5 | 1.17 | 1.85 | 60 |
| | 22 | 33 | 5 | 1.18 | 1.84 | 80 |
| | 23 | 33 | 7 | 1.17 | 1.84 | 60 |

Remarks:
1. Horizontal rolling amount of 250/200 refers to rolling from a slab thickness to 250 mm to a slab thickness of 200 mm.
2. Horizontal rolling amount of 200/2.25 refers to rolling from a slab thickness of 200 mm to a sheet thickness of 2.5 mm.

TABLE 4

| | No. | Slab width (mm) | Gas heating temp. (°C.) | Edging amount (mm) | Horizontal rolling amount before electric heating (mm) | Electric furnace heating temp. (°C.) | Rough horizontal rolling amount (mm) | Temp. at opposite widthwise edges at thin slab tip (°C.) | Horizontal finish rolling amount (mm) |
|---|---|---|---|---|---|---|---|---|---|
| Invention | 24 | 1200 | 1200 | 400 | Dogbone elim. | 1400 | 250/40 | 950 | 40/2.5 |
| | 25 | " | " | " | 250/200 | " | 200/40 | " | " |

| | No. | Hot coil width (mm) | CC production increase (%) | Hot coil worst crack value (mm) | Magnetic properties $W_{17/50}$ (W/kg) | Magnetic properties $B_8$ (γ) | Unit power consumption (kWH/ton) |
|---|---|---|---|---|---|---|---|
| Invention | 24 | 800 | 33 | 2 | 1.18 | 1.84 | 85 |
| | 25 | " | " | 0 | 1.17 | 1.85 | 65 |

Remarks:
1. Horizontal rolling amount before electric heating of 250/200 refers to rolling from a slab thickness to 250 mm to a slab thickness of 200 mm.
2. Rough horizontal rolling amount of 200/40 refers to rolling from slab thickness of 200 mm to a thin slab thickness of 40 mm.
3. "Tin slab tip" refers to a leading 1/5 of 40 mm slab length (approx. 10 m)
4. "Temp. at opposite widthwise edges at thin slab tip" refers to the temperature of this portion at the time of gripping in finish rolling.
5. Finish horizontal rolling amount of 40/2.25 refers to rolling from a thin slab thickness of 40 mm to a hot coil thickness of 2.5 mm.

From the results shown in Table 4 it will be understood that the examples falling within the scope of the present invention exhibit fewer cracks and better magnetic properties than the comparative examples. Nos. 21 and 23, which were reduced to 200 mm by horizontal rolling, are particularly good in both unit power consumption and magnetic properties.

EXAMPLE 4

Slabs of the same composition and size as those in Example 3 were prepared. Each slab was gas heated to 1200° C., subjected to edge rolling at an edging (rolling) amount of 400 mm, was thereafter horizontally rolled (either for flattening by removal of the dogbones or for reduction from a slab thickness of 250 mm to 200 mm), was charged in an electric furnace and heated to 1400° C., was then subjected to about 85% or about 80% horizontal rolling, was charged in an electric tip portion heating furnace to have its tip portion heated to 950° C., and was rolled to a hot-rolled coil sheet thickness of 2.5 mm. The temperature of the center portion of the slab at this time was 1010° C. The result was thereafter subjected to the same processing as in Example 3 to obtain a high flux density grain-oriented electrical sheet. The worst edge crack depth, product properties and unit power consumption in the electric heat[illegible] 3 furnace of the hot-rolled coils produced by this process are shown in Table 4.

From the results shown in Table 4 it will be understood that the examples according to the present invention exhibit very few edge cracks and good magnetic properties.

Thus the present invention enables a marked reduction in the number of edge cracks in grain-oriented electrical steel sheet and also makes it possible to subject a grain-oriented electrical steel slab to heavy-reduction edge rolling, whereby the productivity of grain-oriented electrical steel slab in the continuous casting process can be improved and the heating of the slab in an electric heating furnace following the heavy-reduction edge rolling can be carried out stably and efficiently. The industrial effect of the invention is therefore great.

We claim:

1. A method of hot rolling a continuously cast steel slab having a composition for production of grain-oriented electrical steel that enables improvement of productivity in the continuous casting process wherein a steel slab produced by continous casting is heated, the heated slab is subjected to heavy-reduction edge rolling matched to the required width of a hot-rolled coil following hot rolling and the edge rolled slab is then hot rolled, the hot rolling process including the following steps:

(1) heating the steel slab in a gas-fired heating furnace to a temperature in the range of 900°–1250° C.

(2) subjecting the heated steel slab to heavy-reduction edge rolling of not less than 60 mm, (3) eliminating dogbones formed in the steel slab by the heavy-reduction edge rolling by rolling with horizontal rolls, (4) heating the flat steel slab having the dogbones eliminated in an electric heating furnace to a temperature in the range of 1300°–1450° C., and (5) rough rolling and finish rolling the steel slab electrically heated to said high temperature.

2. A method of hot rolling a continously cast steel slab having a composition for production of grain-oriented electrical steel that enables improvement of productivity in the continous casting process wherein a steel slab produced by continuous casting is heated, the is subjected to heavy-reduction edge rolling matched to the required width of a hot-rolled coil following hot rolling and the edge rolled slab is then hot rolled, the hot rolling process including the following steps:

(1) heating the steel slab in a gas-fired heating furnace to a temperature in the range of 900°–1250° C., (2) subjecting the heated steel slab to heavy-reduction edge rolling of not less than 60 mm, (3) eliminating dogbones formed in the steel slab by the heavy-reduction edge rolling by rolling with horizontal rolls, (4) heating the flat steel slab having the dogbones eliminated in an electric heating furnace to a temperature in the range of 1300°–1450° C., (5) rough rolling the steel slab electrically heated to said high temperature to a thickness of not more than 100 mm, (6) before finishing rolling the rough rolled steel slab, heating both widthwise edges at least at the tip thereof in the lengthwise direction in an electric heating furnace to a temperature of not less than 900° C. and not more than the temperature at the center of the slab, and (7) finish rolling the steel slab maintained at not less than 900° C. throughout its width at least at the tip thereof.

3. A method of hot rolling a continuously cast steel slab according to claim 1 or 2 wherein the horizontal rolling is carried out to eliminate the dogbones and further to reduce the thickness of the slab.

* * * * *

UNITED STATES PATENT AND TRADEMARK OFFICE

CERTIFICATE OF CORRECTION

PATENT NO. : 5,074,931

DATED : December 24, 1991

INVENTOR(S) : Kishio MOCHINAGA, et al.

It is certified that error appears in the above-identified patent and that said Letters Patent is hereby corrected as shown below:

Column 2, line 68, change "dogbones" to --dogbone--.

Column 7, line 7, change "ridged" to --rigid--.

Column 8, line 9, change "a" to --as--.

Column 8, line 21, change "wa" to --was--.

Column 9, line 16 (in Table 2 under Gas heating...), change "1400" to --1000--.

Column 10, line 13 (in Table 2 under Electric furnace..) change "1000" to --1400--.

Column 10, lines 40 and 41, "However," continues on in line 40 after "(tion)." It does not start a new paragraph.

Column 11, line 40 (in Table 4), delete "a" after --to--.

UNITED STATES PATENT AND TRADEMARK OFFICE

CERTIFICATE OF CORRECTION

PATENT NO. : 5,074,931

DATED : December 24, 1991

INVENTOR(S) : Kishio MOCHINAGA, et al.

It is certified that error appears in the above-identified patent and that said Letters Patent is hereby corrected as shown below:

Column 13, line 18, after "the" at the end of the line, insert --heated slab--.

Signed and Sealed this

Seventh Day of September, 1993

Bruce Lehman

*Attest:*

BRUCE LEHMAN

*Attesting Officer*

*Commissioner of Patents and Trademarks*